US012139244B2

(12) United States Patent
Shibayama

(10) Patent No.: US 12,139,244 B2
(45) Date of Patent: Nov. 12, 2024

(54) MARINE VESSEL AND MARINE PROPULSION UNIT

(71) Applicant: YAMAHA HATSUDOKI KABUSHIKI KAISHA, Iwata (JP)

(72) Inventor: Susumu Shibayama, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 441 days.

(21) Appl. No.: 17/569,763

(22) Filed: Jan. 6, 2022

(65) Prior Publication Data

US 2022/0234705 A1 Jul. 28, 2022

(30) Foreign Application Priority Data

Jan. 22, 2021 (JP) ..... 2021-008738

(51) Int. Cl.
*B63H 11/08* (2006.01)
*B63H 11/00* (2006.01)

(52) U.S. Cl.
CPC ..... *B63H 11/08* (2013.01); *B63H 2011/008* (2013.01); *B63H 2011/081* (2013.01)

(58) Field of Classification Search
None
See application file for complete search history.

(56) References Cited

U.S. PATENT DOCUMENTS

| | | | | |
|---|---|---|---|---|
| 6,386,931 | B1 * | 5/2002 | Nanami | B63H 21/30 440/89 R |
| 7,305,928 | B2 * | 12/2007 | Bradley | B63H 25/42 114/144 R |
| 9,321,516 | B1 * | 4/2016 | Lafreniere | B63H 21/20 |
| 11,970,259 | B2 * | 4/2024 | Bangslund | B63H 5/08 |
| 2010/0240266 | A1 * | 9/2010 | Shibayama | B63H 21/213 440/1 |
| 2013/0115832 | A1 * | 5/2013 | Suzuki | B63H 21/20 440/6 |
| 2013/0137317 | A1 * | 5/2013 | Shibayama | B63H 11/04 440/6 |
| 2022/0332398 | A1 * | 10/2022 | Bernatchez | B60L 7/10 |
| 2023/0054594 | A1 * | 2/2023 | Kato | G05D 1/0206 |

FOREIGN PATENT DOCUMENTS

| | | | |
|---|---|---|---|
| JP | 4674841 | B2 | 4/2011 |
| JP | 4783945 | B2 | 9/2011 |
| JP | 2013-107596 | A | 6/2013 |
| JP | 2013-107609 | A | 6/2013 |
| JP | 5844617 | B2 | 1/2016 |

* cited by examiner

*Primary Examiner* — S. Joseph Morano
*Assistant Examiner* — Jovon E Hayes
(74) *Attorney, Agent, or Firm* — Keating & Bennett, LLP

(57) ABSTRACT

A marine vessel includes a hull, a jet pump including an impeller, a plurality of motors, and a transmission to transmit outputs of the plurality of motors to the impeller of the jet pump.

17 Claims, 9 Drawing Sheets

MARINE VESSEL AND MARINE PROPULSION UNIT

CROSS REFERENCE TO RELATED APPLICATIONS

This application claims the benefit of priority to Japanese Patent Application No. 2021-008738 filed on Jan. 22, 2021. The entire contents of this application are hereby incorporated herein by reference.

BACKGROUND OF THE INVENTION

1. Field of the Invention

The present invention relates to marine vessels and marine propulsion units.

2. Description of the Related Art

Conventionally, as a propulsion unit for a marine vessel, a jet pump that propels the marine vessel such as a water jet propulsion boat is known. For example, Japanese Laid-Open Patent Publication (kokai) No. 2013-107596 has disclosed a propulsion unit that rotationally drives an impeller of a jet pump by means of an electric motor.

However, in the case of driving a rotating shaft of the impeller by one motor as disclosed in Japanese Laid-Open Patent Publication (kokai) No. 2013-107596, a large output is required for the motor used. Therefore, it is conceivable to mount a high-power (large output) motor. However, in order to arrange a large-sized motor, if the position of an output shaft of the motor is higher than the bottom of the marine vessel (hereinafter referred to as "a vessel bottom"), the propulsion efficiency will decrease. Therefore, in the case of driving the jet pump by one large-sized motor, there is a problem that the degree of freedom in the layout of the marine vessel is lowered.

SUMMARY OF THE INVENTION

Preferred embodiments of the present invention provide marine vessels and marine propulsion units that are able to increase the degree of freedom in the layout of the marine vessels.

According to a preferred embodiment of the present invention, a marine vessel includes a hull, a jet pump including an impeller, a plurality of motors, and a transmission to transmit outputs of the plurality of motors to the impeller of the jet pump.

According to another preferred embodiment of the present invention, a marine propulsion unit includes a jet pump including an impeller, a plurality of motors, and a transmission to transmit outputs of the plurality of motors to the impeller of the jet pump.

According to preferred embodiments of the present invention, outputs of a plurality of motors are transmitted to the impeller of the jet pump by a transmission. As a result, it is possible to increase the degree of freedom in the layout of the marine vessel.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1:
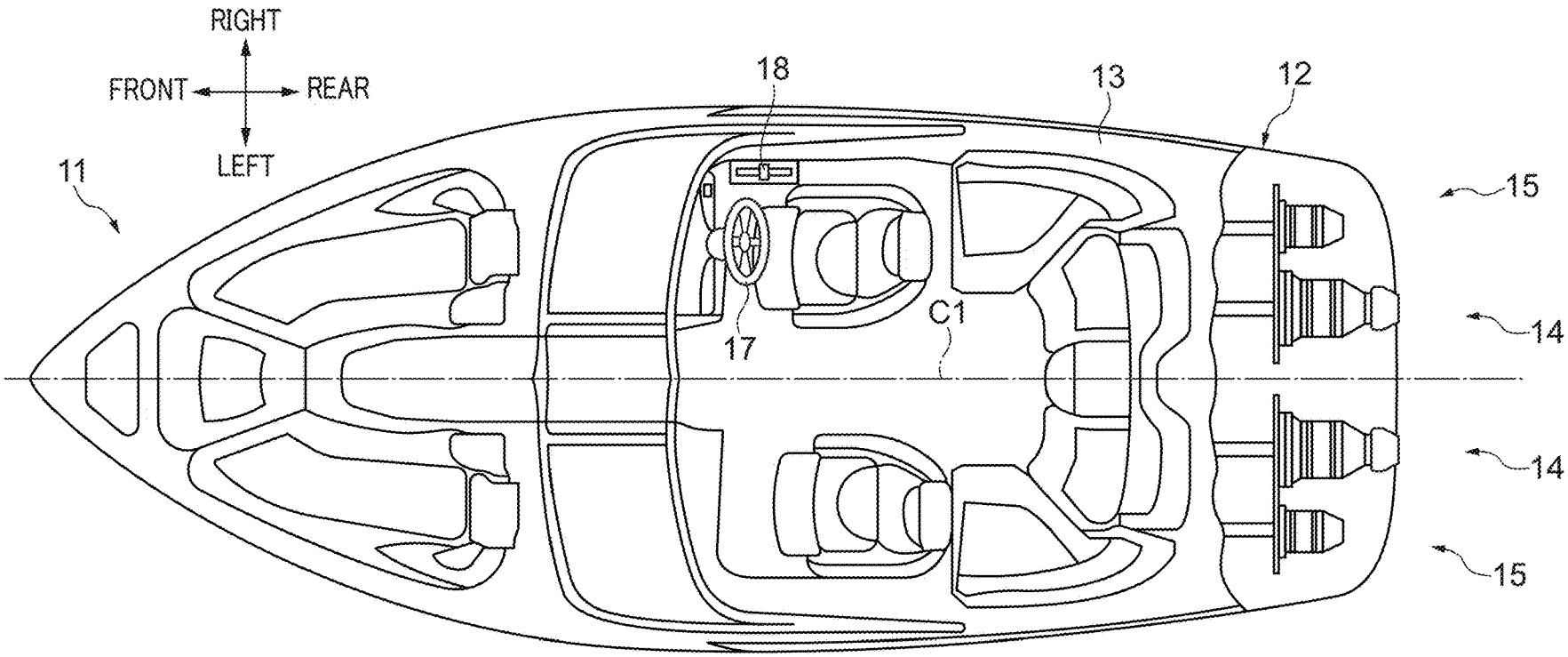
FIG. 1 is a schematic plan view of a marine vessel, to which a marine propulsion unit according to a first preferred embodiment of the present invention is applied.

First, a first preferred embodiment of the present invention will be described. FIG. 1 is a schematic plan view of a marine vessel, to which a marine propulsion unit according to the first preferred embodiment of the present invention is applied. In FIG. 1, a portion of a marine vessel 11 is shown in an exposed view. The marine vessel 11 includes a hull 12, and a deck 13 disposed on an upper portion of the hull 12. The marine vessel 11 is, for example, a water jet propulsion boat.

In the following description, as shown in FIG. 1, front, rear, left, and right directions refer to front, rear, left, and right directions of the hull 12, respectively. The right-and-left direction is defined with reference to the hull 12 being viewed from the rear. A vertical direction is a direction perpendicular to the front-and-rear direction and the right-and-left direction. Further, the vertical direction is a direction perpendicular to an upper surface of the deck 13.

The marine vessel 11 includes a plurality of propulsion units 14 and 15 to propel the hull 12, a steering handle 17, and an output adjusting unit 18 (e.g., throttle). The steering handle 17 is operated by a vessel operator to steer the marine vessel 11. The output adjusting unit 18 includes a lever, etc., and is operated by the vessel operator to adjust a thrust force and perform switching of traveling directions. The steering handle 17 and the output adjusting unit 18 are disposed in a maneuvering seat provided on the deck 13.

The plurality of propulsion units 14 and 15 are mounted on a rear portion of the hull 12. Each of two first propulsion units 14 uses an engine 34 (see FIG. 2) as a power source. Further, each of two second propulsion units 15 uses two or more electric motors (see FIG. 2) as the power source. All of the first propulsion units 14 and the second propulsion units 15 are jet propulsion units. The propulsion units 14 and 15 are independent of each other.

A pair of the first propulsion units 14 are disposed symmetrically with respect to a vertical plane (a hull center C1) passing through a bow and the center of a stern. Further, a pair of the second propulsion units 15 are disposed at locations farther from the hull center C1 than the pair of the first propulsion units 14 in a width direction of the hull 12, and are disposed symmetrically with respect to the hull center C1.

Figure 2:
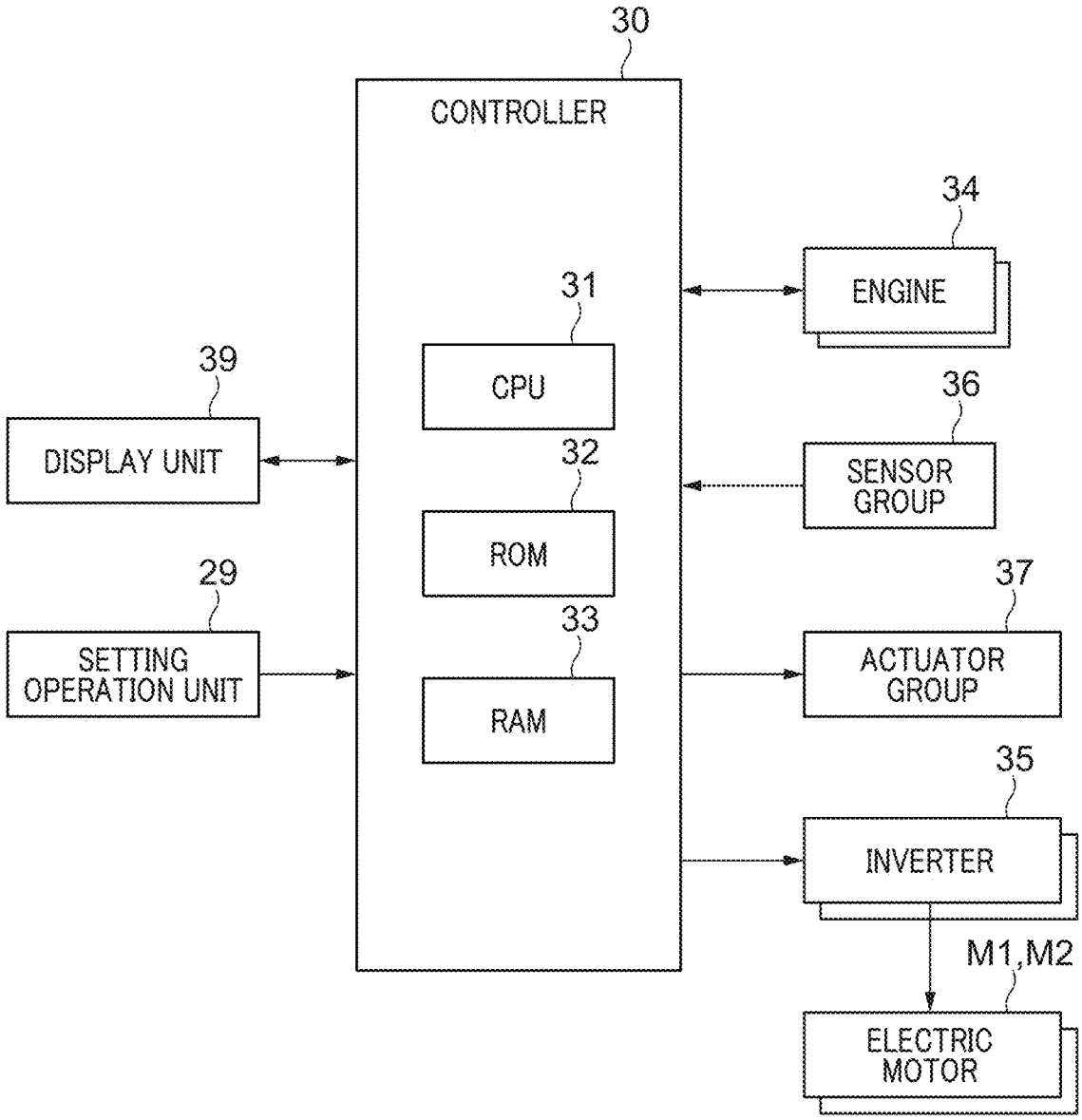
FIG. 2 is a block diagram of a maneuvering system mounted on the marine vessel.

FIG. 2 is a block diagram of a maneuvering system mounted on the marine vessel 11. As components mainly related to maneuvering, in addition to the steering handle 17 and the output adjusting unit 18 that are described above, the maneuvering system includes a controller 30, a display unit 39, a setting operation unit 29, a plurality of engines 34, a sensor group 36, an actuator group 37, and a plurality of inverters 35. A plurality of electric motors M1 and M2 are included in each of the second propulsion units 15. That is, each of the second propulsion units 15 includes the electric motors M1 and M2. An inverter 35 is provided for each of the electric motors M1 and M2.

The sensor group 36 includes a steering angle sensor, a lever position sensor, a hull speed sensor, a hull acceleration sensor, a posture sensor, an engine speed sensor, and the like (none are shown). The actuator group 37 includes actuators that drive deflectors (not shown) provided within the first propulsion units 14. The deflectors are components to change a direction of a jet flow to the left or right.

The controller 30 includes a CPU (Central Processing Unit) 31, a ROM (Read Only Memory) 32, a RAM (Random Access Memory) 33, and a timer (not shown). The ROM 32 stores control programs. The CPU 31 performs various kinds of control processes by executing the control programs, which are stored in the ROM 32, in the RAM 33. The RAM 33 provides a work area for the CPU 31 to execute the control programs.

The display unit 39 displays various kinds of information. The setting operation unit 29 includes an operator to perform operations related to the maneuvering, a setting operator to perform various kinds of settings, and an input operator to input various kinds of instructions (none are shown). Various kinds of detection results obtained by the sensor group 36 are supplied to the controller 30.

In the sensor group 36, the hull speed sensor and the hull acceleration sensor detect a speed and an acceleration of navigation of the marine vessel 11 (the hull 12), respectively. The posture sensor includes, for example, a gyro sensor, a magnetic azimuth sensor, etc. The engine speed sensor detects the number of rotations per unit time of the engine 34. The steering angle sensor detects a turning angle of the steering wheel 17. The lever position sensor detects a shift position of the output adjusting unit 18.

The first propulsion unit 14 may include an engine ECU (Electronic Control Unit), and the second propulsion unit 15 may include a motor ECU. In this case, the controller 30 functions as a main ECU and controls the engine ECU and the motor ECU.

The output adjusting unit 18 is movable in an F region, an N region, and an R region. The N region is provided between the F region and the R region. The F region is a region that makes the marine vessel 11 go forward, and the R region is a region that makes the marine vessel 11 go rearward.

The controller 30 propels the marine vessel 11 by at least either of the first propulsion units 14 and the second propulsion units 15. The vessel operator is able to select an operation mode by operating the setting operation unit 29. The operation modes include a manual mode. The manual mode includes an engine mode in which the marine vessel 11 is propelled only by the pair of the first propulsion units 14, an electric mode in which the marine vessel 11 is propelled only by the pair of the second propulsion units 15, and an assist mode in which the first propulsion units 14 and the second propulsion units 15 cooperate to propel the marine vessel 11. The electric mode will be mainly described.

In the electric mode, when the vessel operator instructs the marine vessel 11 to go forward straight, the steering handle 17 is operated to a straight-ahead position, and the output adjusting unit 18 is located in the F region. In this state, the controller 30 controls the electric motors M1 and M2 within each of the second propulsion units 15 so that the magnitudes of outputs of the two second propulsion units 15 match. When the vessel operator turns the marine vessel 11 while instructing it to go forward, the steering handle 17 is steered, and the output adjusting unit 18 is located in the F region. In this state, the controller 30 controls the electric motors M1 and M2 within each of the second propulsion units 15 so that the magnitudes of the outputs of the two second propulsion units 15 are different from each other.

In the case of instructing the marine vessel 11 to go rearward, the output adjusting unit 18 is located in the R region, and rotation directions of the electric motors M1 and M2 are reversed with respect to the go forward case described above. Further, in the case of rotating the marine vessel 11 at the same point, the rotation directions of the electric motors M1 and M2 within one of the second propulsion units 15 and the rotation directions of the electric motors M1 and M2 within another of the second propulsion units 15 may be reversed. Moreover, the second propulsion units 15 may also be provided with deflectors to change the direction of the jet flow to the left or right. In that case, the controller 30 controls the deflectors to have a posture that a water jetting direction is tilted to the left or right with respect to the front-and-rear direction in a plan view.

Next, the detailed configurations of the second propulsion units 15 will be described. Since the configurations of the two second propulsion units 15 are the same except that they are symmetrical in the right-and-left direction, one of the second propulsion units 15 will be described.

Figure 3:
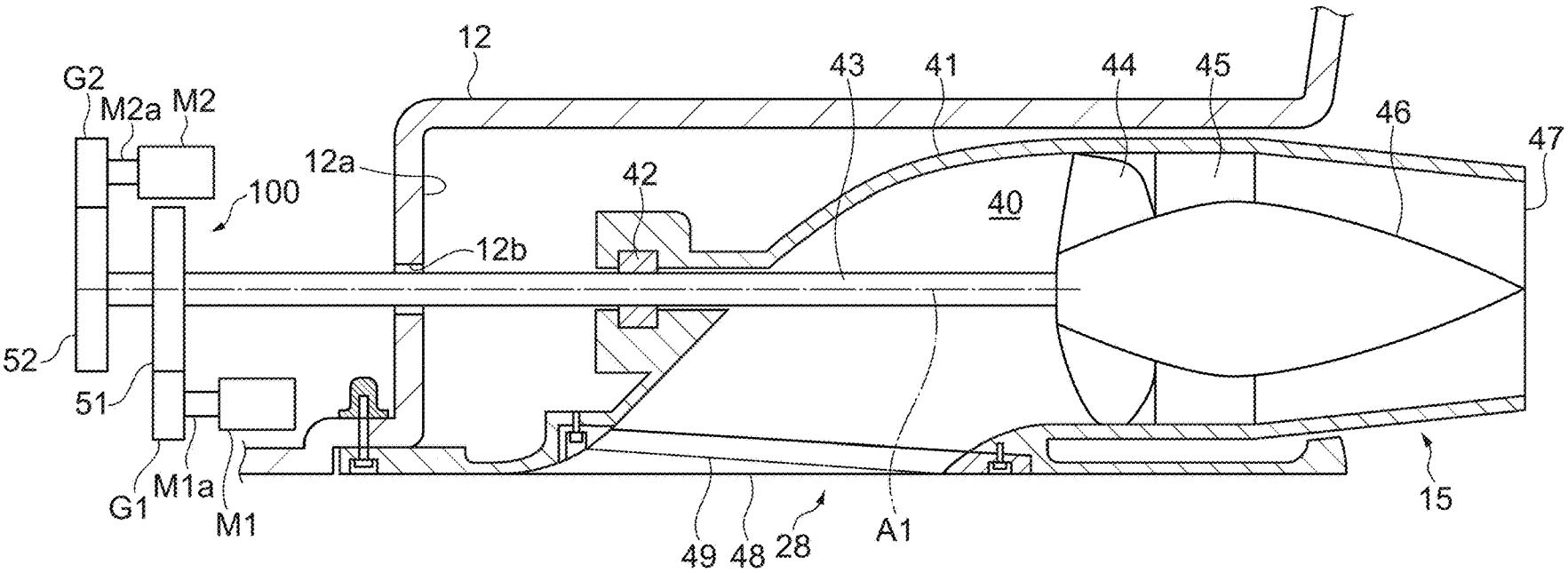
FIG. 3 is a longitudinal section view of a second propulsion unit.

FIG. 3 is a longitudinal section view of the second propulsion unit 15. The second propulsion unit 15 mainly includes a jet pump 28 and a transmission unit 100. The jet pump 28 of the second propulsion unit 15 is disposed on the outside of the hull 12. Specifically, the jet pump 28 is accommodated in an accommodation portion 12*a*, which is formed on the outside of the bottom of the rear portion of the hull 12. However, the transmission unit 100 of the second propulsion unit 15 is mainly disposed inside the hull 12. The accommodation portion 12*a* is recessed upward from the vessel bottom.

The jet pump 28 includes a duct 41. The second propulsion unit 15 is mounted on the hull 12 by fixing a front portion of the duct 41 to the hull 12 with a plurality of bolts, for example. The jet pump 28 is driven by the electric motors M1 and M2, sucks in water from the vessel bottom, and jets the sucked in water rearward. The jet pump 28 has a streamlined housing 46 extending in the front-and-rear direction and a flow path 40 defined by flow forming members. The jet pump 28 includes an impeller 44 and a stationary blade 45 disposed in the flow path 40, as well as a grid-like screen 49 to prevent foreign matter from entering the flow path 40. The flow forming members include the duct 41 that defines a water suction port 48, a cylindrical moving blade housing portion that surrounds the impeller 44, a tubular stationary blade housing portion that surrounds the stationary blade 45, and a nozzle portion that defines an injection port 47.

The second propulsion unit 15 includes a drive shaft 43 as an element of the transmission unit 100. The drive shaft 43 is disposed in the front-and-rear direction so as to extend insides and outside of the hull 12, and transmits rotations of the electric motors M1 and M2 to the impeller 44. The water suction port 48 opens downward at the vessel bottom. The injection port 47 opens rearward behind the water suction port 48. The flow path 40 connects the water suction port 48 and the injection port 47. The flow path 40 extends rearward from the water suction port 48 diagonally upward.

The impeller 44 includes a plurality of vanes (a moving blade) that are disposed around a rotating shaft line A1 extending in the front-and-rear direction. Similarly, the stationary blade 45 includes a plurality of vanes that are disposed around the rotating shaft line A1 behind the impeller 44. The stationary blade 45 is disposed around the housing 46. The impeller 44 is connected to the drive shaft 43. The drive shaft 43 is also a rotating shaft of the impeller 44. Therefore, the impeller 44 is rotatable around the rotating shaft line A1 with respect to the flow path 40. On the other hand, the stationary blade 45 is fixed to the housing 46 and the stationary blade housing portion, and does not rotate with respect to the flow path 40.

The drive shaft 43 is pivotally supported on a shaft support 42 by the duct 41. The shaft support 42 includes a bearing and a seal. Further, the drive shaft 43 penetrates a through hole 12*b* of the hull 12 in front of the shaft support 42. The through hole 12*b* includes a seal. Therefore, the drive shaft 43 is rotatable about the rotating shaft line A1.

The transmission unit 100 includes the drive shaft 43, the electric motors M1 and M2, drive gears G1 and G2, and driven gears 51 and 52. The drive gears G1 and G2 are connected and fixed to output shafts M1*a* and M2*a* of the electric motors M1 and M2, respectively. The driven gears 51 and 52 are driven units corresponding to the electric motors M1 and M2, respectively. The driven gears 51 and 52 are connected to the drive shaft 43 at different locations in a direction of the rotating shaft line A1 (an axial direction of the rotating shaft of the impeller 44). That is, the driven gears 51 and 52 are disposed in series in the rotating shaft line A1 direction. The driven gears 51 and 52 and the drive shaft 43 rotate integrally. The drive gears G1 and G2 as drive units mesh with the driven gears 51 and 52, respectively. Outputs of the electric motors M1 and M2 are transmitted to the driven gears 51 and 52 via the drive gears G1 and G2, respectively. Therefore, the drive shaft 43 is rotationally driven by the electric motors M1 and M2. The maximum outputs of the electric motors M1 and M2 according to the standard are equal or substantially equal.

The electric motors M1 and M2 (the output shafts M1*a* and M2*a*) are able to rotate in a forward rotation direction and a reverse rotation direction. When the electric motors M1 and M2 rotate in the forward rotation direction (for example, in a clockwise direction when viewed from the rear), the impeller 44 also rotates in the forward rotation direction. As a result, water is sucked into the flow path 40 from the water suction port 48, and the sucked in water is sent from the impeller 44 to the stationary blade 45. The stationary blade 45 reduces the torsion of the water flow caused by the rotation of the impeller 44 and regulates the water flow. Then, the rectified water is jetted rearward from the injection port 47. As a result, a jet of water is formed, and a thrust force in a go forward direction is generated with respect to the hull 12. On the other hand, when the electric motors M1 and M2 rotate in the reverse rotation direction, the impeller 44 also rotates in the reverse rotation direction. Therefore, water is sucked into the flow path 40 from the injection port 47, and the sucked in water is jetted forward from the water suction port 48 diagonally downward. As a result, a thrust force in a go rearward direction is generated with respect to the hull 12. As described above, the second propulsion unit 15 is configured so that the direction of the thrust force is able to be changed by switching the rotation direction of the impeller 44.

In such a configuration, the controller 30 controls the electric motors M1 and M2 based on the shift position of the output adjusting unit 18 detected by the lever position sensor. The controller 30 determines the rotation directions of the electric motors M1 and M2 depending on whether the shift position of the output adjusting unit 18 belongs to the F region or the R region. Further, the controller 30 determines an indicated speed according to the shift position (an operation amount) of the output adjusting unit 18, and controls rotational speeds of the electric motors M1 and M2 by using the inverter 35 and according to the indicated speed. Since the rotational speeds of the electric motors M1 and M2 are variable, the output of the second propulsion unit 15 is easily adjusted. The controller 30 uses the inverter 35 to perform synchronous control so that the rotations of the electric motors M1 and M2 are synchronized with each other. This is because if the rotational speeds of the electric motors M1 and M2 are different, the slower electric motor becomes a resistance to the rotation drive, and the drive efficiency will decrease. Since the outputs of the electric motors M1 and M2 are equal or substantially equal to each other, the operation efficiency of each motor is high.

Moreover, the electric motor that actually operates among the electric motors M1 and M2 may be determined according to the indicated speed. For example, in the case that the indicated speed is equal to or less than a predetermined speed, only one of the electric motors M1 and M2 may be operated. In this case, it may be configured that a mechanical connection between the drive gear G1 and the driven gear 51 and a mechanical connection between the drive gear G2 and the driven gear 52 is able to be released. Alternatively, it may be configured that even in the case that the electric motors M1 and M2 are stopped, the drive gears G1 and G2 or the output shafts M1*a* and M2*a* are able to idle. In this way, by selectively operating some of the electric motors among the plurality of electric motors, it is easy to adjust the output of the second propulsion unit 15.

According to the first preferred embodiment, since the outputs of the plurality of electric motors M1 and M2 are transmitted to the impeller 44 by the transmission unit 100, it is possible to increase the degree of freedom in the layout by driving the jet pump by the plurality of the motors. For example, it becomes easy to design the drive shaft 43 to be close to the vessel bottom. Generally, a large-sized motor has a high development cost and a high cost of the motor itself. However, in the first preferred embodiment, since the output is obtained by a plurality of small-sized electric motors, it is possible to use versatile and inexpensive motors, and as a result, it is possible to minimize the cost. Further, even in the case that some electric motors break down, it is still possible to operate the jet pump 28.

Further, since the electric motors M1 and M2 are disposed in the inside of the hull 12, it is easy to ensure the waterproofness of the electric motors M1 and M2.

Furthermore, the driven gears 51 and 52 are disposed in series at different locations in the rotating shaft line A1 direction, and correspondingly, the drive gears G1 and G2 are also disposed at different locations in the rotating shaft line A1 direction. As a result, it becomes easy to dispose the plurality of electric motors at different locations in the rotating shaft line A1 direction, and the layout is further eased.

Further, since respective rotational speeds of the plurality of electric motors are controlled based on the indicated speed, it becomes easy to adjust the output of the second propulsion unit 15. Moreover, in the case of selectively operating some of the electric motors among the plurality of electric motors based on the indicated speed, it also becomes easy to adjust the output of the second propulsion unit 15.

Figure 4:
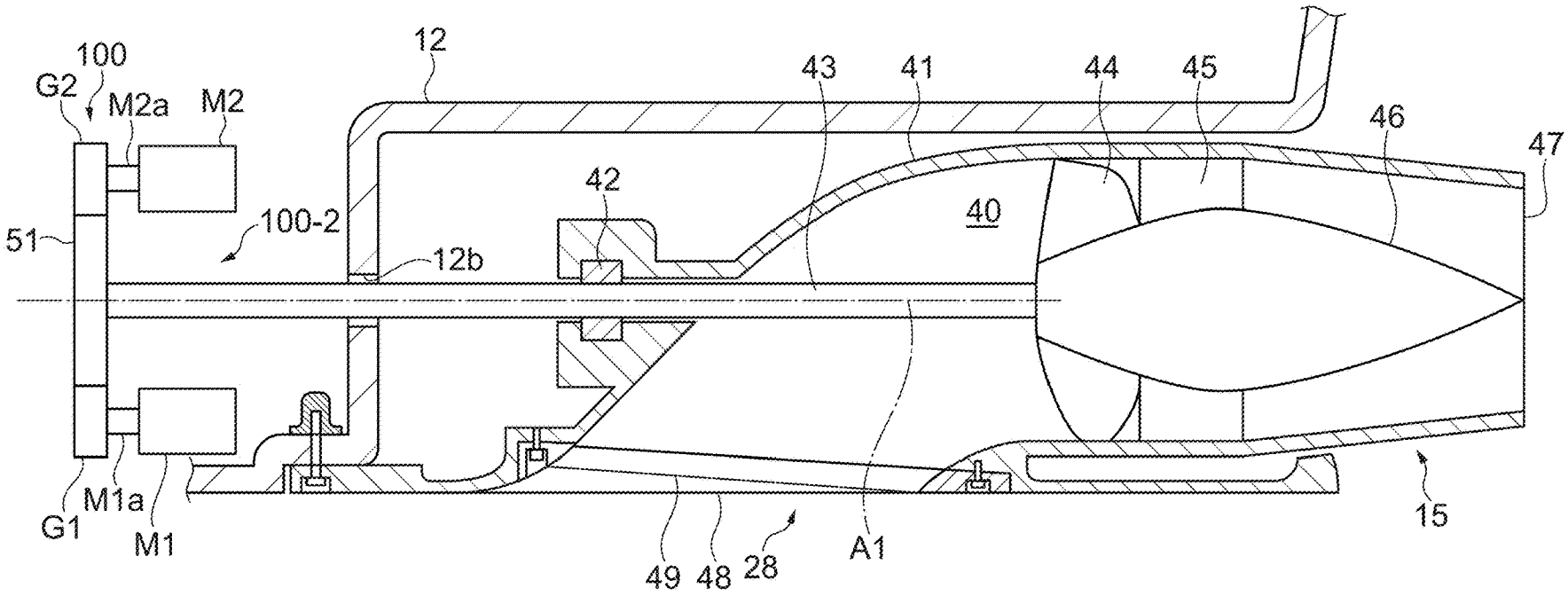
FIG. 4 is a longitudinal section view of a second propulsion unit according to a second preferred embodiment of the present invention.

Next, a second preferred embodiment of the present invention will be described. FIG. 4 is a longitudinal section view of a second propulsion unit 15 according to the second preferred embodiment of the present invention. This second propulsion unit 15 includes a transmission unit 100-2. In the first preferred embodiment, the two driven gears 51 and 52 are disposed at different locations in the rotating shaft line A1 direction. On the other hand, in the second preferred embodiment, only one driven gear is provided. Further, the drive gears G1 and G2 are disposed at the same locations in the rotating shaft line A1 direction.

That is, in the transmission unit 100-2, the drive gears G1 and G2 are meshed with one driven gear 51 at different locations in the circumferential direction of the one driven gear 51. The locations of the electric motors M1 and M2 in the rotating shaft line A1 direction are the same. Therefore, the drive gears G1 and G2 are disposed in parallel, and correspondingly, the electric motors M1 and M2 are also disposed in parallel. Other configurations and controls are the same as those in the first preferred embodiment.

According to the second preferred embodiment, it is possible to obtain the same effects as that of the first preferred embodiment with respect to increasing the degree of freedom in the layout by driving the jet pump by the plurality of the motors.

Further, it becomes easy to dispose the plurality of electric motors at a common location in the rotating shaft line A1 direction, and the layout is further eased. The second preferred embodiment is especially useful when there is insufficient space in the front-and-rear direction.

Figure 5:
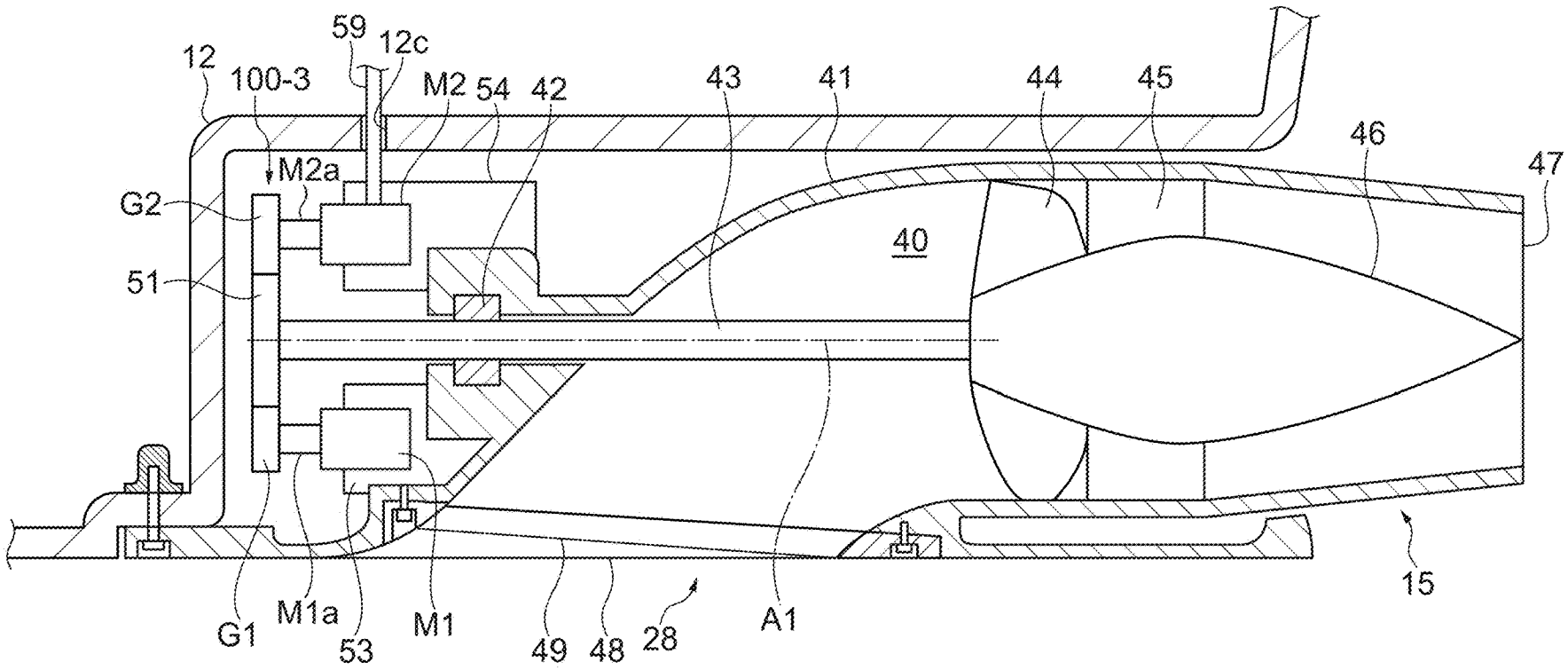
FIG. 5 is a longitudinal section view of a second propulsion unit according to a third preferred embodiment of the present invention.

Next, a third preferred embodiment of the present invention will be described. FIG. 5 is a longitudinal section view of a second propulsion unit 15 according to the third preferred embodiment of the present invention. This second propulsion unit 15 includes a transmission unit 100-3. In the first preferred embodiment and the second preferred embodiment, the electric motors M1 and M2 are disposed in the inside of the hull. On the other hand, in the third preferred embodiment, the electric motors M1 and M2 are disposed on the outside of the hull.

That is, the main portions of the electric motors M1 and M2, and the main portion of the transmission unit 100-3 are disposed between the duct 41 and the hull 12 in the accommodation portion 12*a*. The electric motor M1 is fixed to the duct 41 via a stay 53. Further, the electric motor M2 is fixed to the duct 41 via a stay 54. In the accommodation portion 12*a*, the drive gears G1 and G2 are meshed with one driven gear 51. The locations of the electric motors M1 and M2 in the rotating shaft line A1 direction are the same. Therefore, the drive gears G1 and G2 are disposed in parallel, and correspondingly, the electric motors M1 and M2 are also disposed in parallel. Other configurations and controls are the same as those in the first preferred embodiment.

Further, electric power and control signals are supplied to the electric motors M1 and M2 via a wire 59. The wire 59 penetrates a through hole 12*c* of the hull 12. The through hole 12*c* includes a seal.

According to the third preferred embodiment, it is possible to obtain the same effects as that of the first preferred embodiment with respect to increasing the degree of freedom in the layout by driving the jet pump by the plurality of the motors.

Further, since the electric motors M1 and M2 are disposed on the outside of the hull 12, the electric motors M1 and M2 are easily cooled by water. Therefore, it is not necessary to provide a cooling mechanism for the electric motors M1 and M2.

Moreover, if a space is provided in the accommodation portion 12*a*, similar to the first preferred embodiment, two driven gears may be disposed in series at different locations in the rotating shaft line A1 direction, and correspondingly, the drive gears G1 and G2 may also be disposed at different locations in the rotating shaft line A1 direction.

Figure 6:
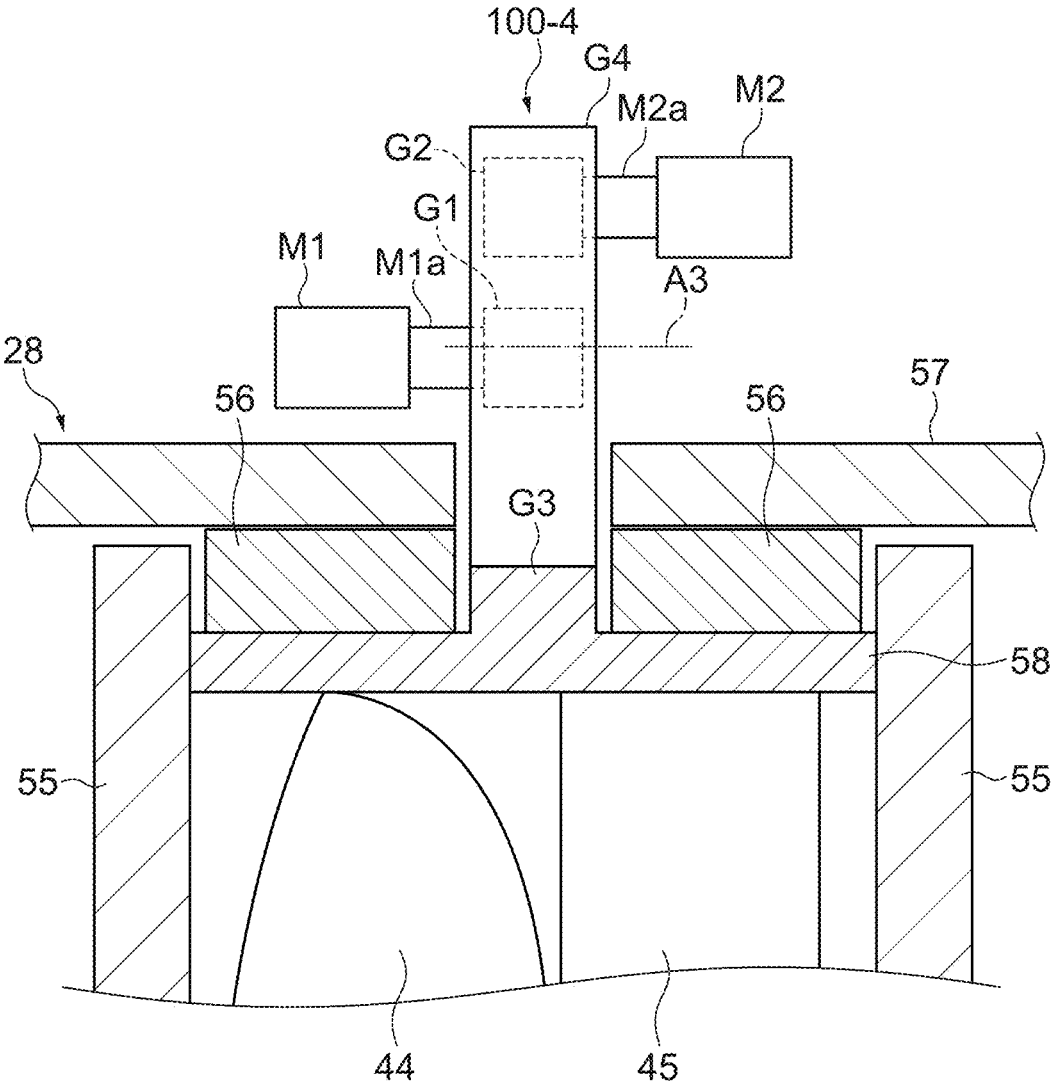
FIG. 6 is a longitudinal section view of a main portion of a second propulsion unit according to a fourth preferred embodiment of the present invention.

Next, a fourth preferred embodiment of the present invention will be described. FIG. 6 is a longitudinal section view of the main portion of a second propulsion unit 15 according to the fourth preferred embodiment of the present invention. This second propulsion unit 15 includes a jet pump 28 and a transmission unit 100-4. In the fourth preferred embodiment, the electric motors M1 and M2 are disposed on the outside of the hull. Further, the drive shaft 43 is eliminated, and the transmission unit 100-4 is disposed around (mainly, the upper side of) the impeller 44 and the stationary blade 45.

As shown in FIG. 6, the jet pump 28 includes a duct 57, and the duct 57 is fixed to the hull 12. A rim 58 is disposed within the duct 57. The rim 58 is supported by the duct 57 via two thrust bearings 55 and two radial bearings 56. The rim 58 holds the impeller 44 and the stationary blade 45 on the inner circumference thereof. The rim 58 rotates integrally with the impeller 44 about a rotating shaft line corresponding to the rotating shaft line A1 (FIG. 3). The rim 58 includes a first gear G3 (the driven unit) on the outer circumference portion. A second gear G4 is disposed in a gap of the duct 57. The second gear G4 is meshed with the first gear G3, and is driven by the first gear G3 to rotate about a rotating shaft line A3. The drive gears G1 and G2 are meshed with one second gear G4 at different locations in the circumferential direction of the one second gear G4. Respective outputs of the electric motors M1 and M2 are transmitted to the first gear G3 via the drive gears G1 and G2, and the second gear G4, and the rim 58 is rotationally driven.

According to the fourth preferred embodiment, it is possible to obtain the same effects as that of the first preferred embodiment with respect to increasing the degree of freedom in the layout by driving the jet pump by the plurality of the motors.

Further, since the rim 58 is rotationally driven by the electric motors M1 and M2, the impeller 44 on the inner circumference of the rim 58 is rotated, and as a result, the drive shaft becomes unnecessary.

Moreover, the drive gears G1 and G2 may be directly meshed with the first gear G3 without providing the second gear G4. Therefore, the drive gears G1 and G2 may be drive units that directly or indirectly transmit driving forces of the electric motors M1 and M2 to the driven unit such as the first gear G3.

In each of the above-described preferred embodiments, a plurality of electric motors are provided, and may be three or more. Other preferred locations of the plurality of electric motors with respect to a rotation center (the rotating shaft line A1) of the impeller 44 will be described with reference to FIGS. 7 and 8. The arrangements shown in FIGS. 7 and 8 can be applied to any one of the first to fourth preferred embodiments described above.

Figure 7:
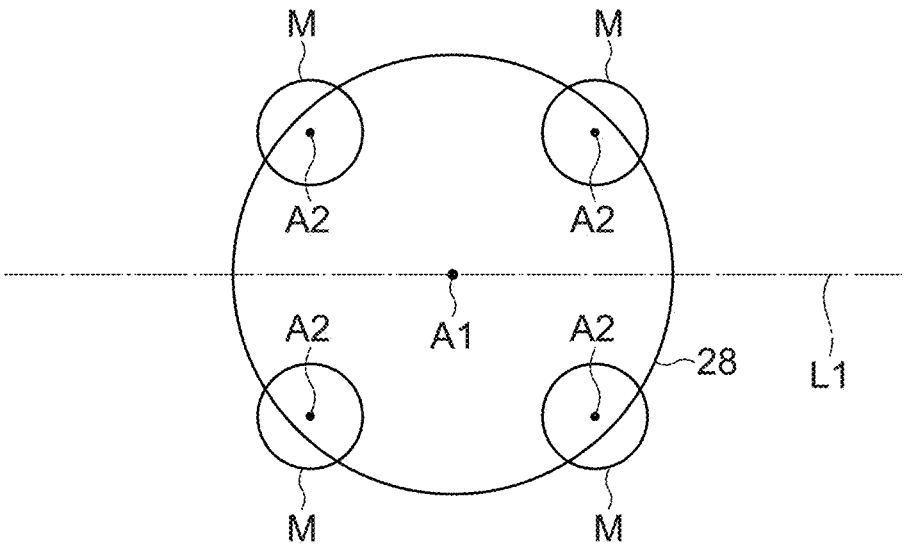
FIG. 7 is a schematic view that shows a spatial relationship between a jet pump and a plurality of electric motors.
Figure 8:
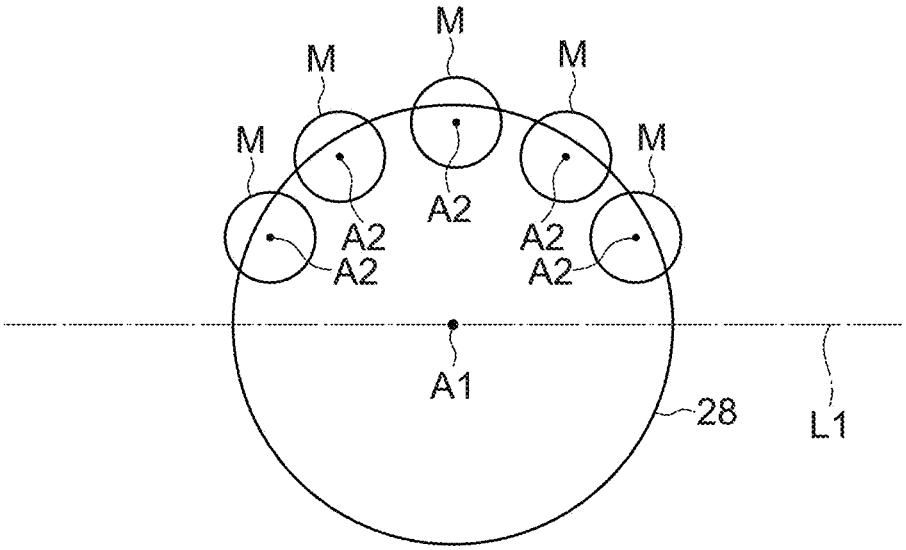
FIG. 8 is a schematic view that shows a spatial relationship between the jet pump and a plurality of electric motors.

FIGS. 7 and 8 are schematic views that show a spatial relationship between the jet pump 28 and the plurality of electric motors. The driven gear and the drive gear are not shown in FIGS. 7 and 8. The output shafts (not shown) of a plurality of electric motors M rotate about their respective rotation centers A2. Moreover, in the description of FIGS. 7 and 8, the location of each electric motor M in the vertical direction and the horizontal direction is defined with respect to the location of the rotation center A2.

First, in the preferred embodiment shown in FIG. 7, two electric motors M are disposed above a horizontal plane L1 passing through the rotating shaft line A1, and two electric motors M are disposed below the horizontal plane L1 passing through the rotating shaft line A1. In particular, the plurality of electric motors M are disposed at equal or substantially equal intervals around the rotation center (the rotating shaft line A1) of the impeller 44. As a result, radial forces received by the drive shaft 43 (or the rim 58) from the plurality of electric motors M are canceled out and become zero or close to zero. Therefore, the eccentricity of the rotation of the impeller 44 is reduced, and the impeller 44 rotates stably.

Moreover, from the viewpoint of stable rotation of the impeller 44, the arrangement of the plurality of electric motors M is not limited to equal or substantially equal intervals. For example, in the case that the number of the electric motors M is an even number, there may be a plurality of pairs of electric motors M disposed diagonally across the rotation center of the impeller 44.

Next, in the preferred embodiment shown in FIG. 8, all of the plurality of electric motors M are closely disposed at locations higher than the rotation center (the rotating shaft line A1) of the impeller 44. That is, all of the electric motors M are located above the horizontal plane L1. This facilitates the design of disposing the jet pump 28 as low as possible. This makes it easier for the jet pump 28 to be immersed in water, which contributes to increasing the propulsion efficiency.

Moreover, in the above-described preferred embodiments, the driven gears 51 and 52, and the first gear G3 are exemplified as the driven units that rotate integrally with the impeller 44, and the drive gears G1 and G2 are exemplified as the drive units that transmit the outputs of the electric motors to the driven unit. However, the mechanism to transmit the driving forces of the electric motors is not limited to gears, and for example, a belt or the like may be used.

Furthermore, in each of the above-described preferred embodiments, the marine vessel 11 is a hybrid type marine vessel provided with the propulsion units 14 and 15. However, it is not essential to provide the first propulsion unit 14, and only the second propulsion unit 15 may be provided. For example, as in a modified preferred embodiment shown in FIG. 9, the present invention can be applied to a PWC (Personal Watercraft) that has only the second propulsion unit 15, which uses an electric motor as the power source, without having an engine. Therefore, the present invention can be applied to electric water motorcycles, electric underwater motorcycles, and even kayaks.

Figure 9:
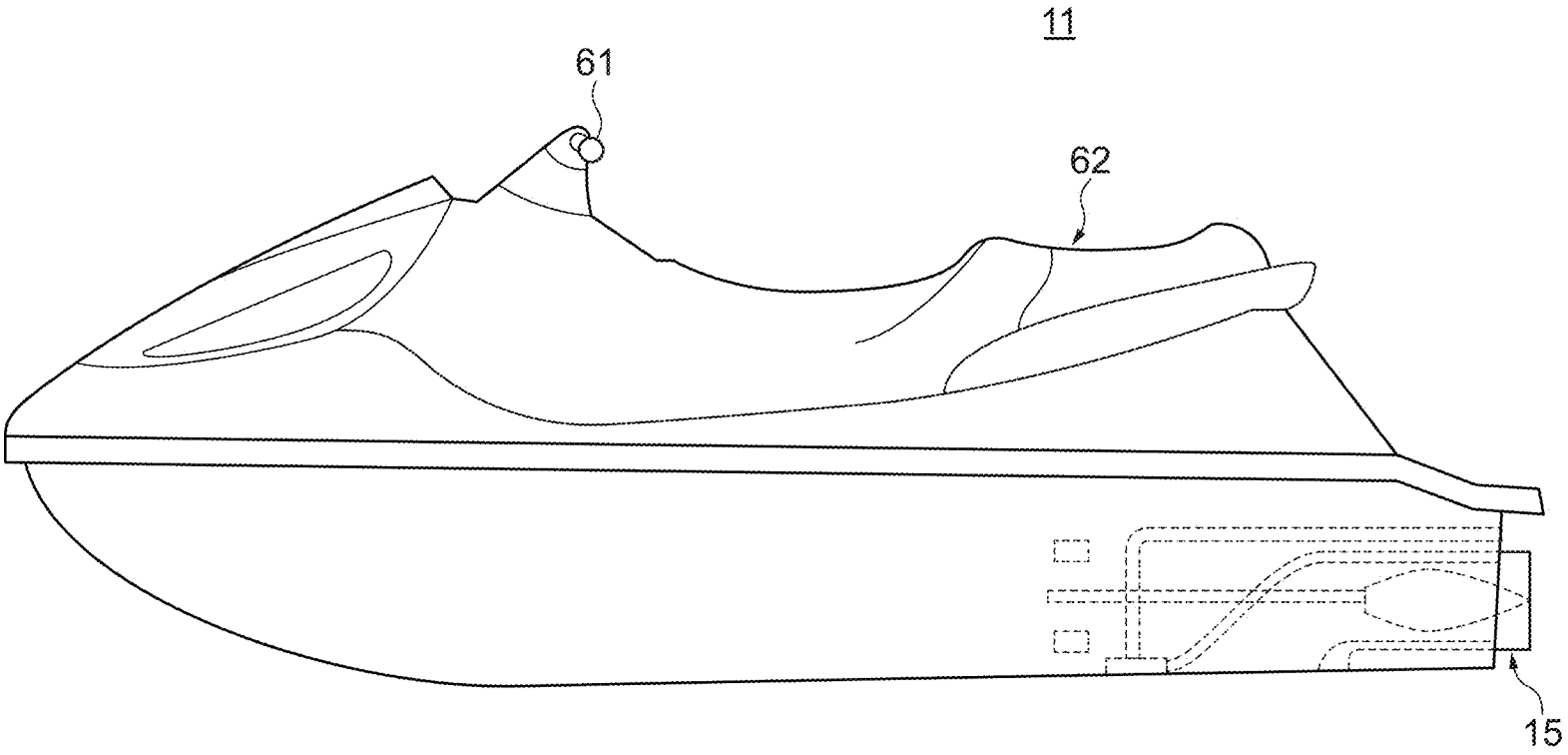
FIG. 9 is a schematic view of a marine vessel according to modified preferred embodiment of the present invention.

FIG. 9 is a schematic view of a marine vessel 11 according to the modified preferred embodiment. This marine vessel 11 is a saddle riding type PWC that is equipped with a saddle type seat 62. The vessel operator sits down and operates a handle 61. Although the marine vessel 11 includes one second propulsion unit 15, the marine vessel 11 may include a plurality of the second propulsion units 15. Moreover, as the second propulsion unit 15, any one of the above-described first to fourth preferred embodiments may be applied. Further, the present invention can also be applied to a standing riding type PWC as shown in FIG. 19B of Japanese Laid-Open Patent Publication (kokai) No. 2013-107596.

Although the present invention has been described in detail based on the preferred embodiments above, the present invention is not limited to these specific preferred embodiments, and various preferred embodiments within the scope of the gist of the present invention are also included in the present invention. Some of the above-described preferred embodiments may be combined as appropriate.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine vessel comprising:
a hull;
a jet pump including an impeller;
a plurality of motors; and
a transmission to transmit outputs of the plurality of motors to the impeller of the jet pump.

2. The marine vessel according to claim 1, wherein the plurality of motors are disposed inside the hull.

3. The marine vessel according to claim 1, wherein the plurality of motors are disposed outside the hull.

4. The marine vessel according to claim 1, wherein the transmission includes:
a plurality of driven units corresponding to the plurality of motors, respectively, and disposed at different locations in an axial direction of a rotating shaft of the impeller; and
a plurality of drive units corresponding to the plurality of motors, respectively, to transmit the outputs of the plurality of motors to the corresponding plurality of driven units.

5. The marine vessel according to claim 1, wherein the transmission unit includes:
a driven unit disposed on a rotating shaft of the impeller; and
a plurality of drive units corresponding to the plurality of motors, respectively, to transmit the outputs of the plurality of motors to the driven unit.

6. The marine vessel according to claim 1, wherein the transmission unit includes:
a rim including a driven unit on an outer circumference of the rim, to hold the impeller on an inner circumference of the rim, and rotate integrally with the impeller; and
a plurality of drive units fixed to output shafts of the plurality of motors, respectively, to directly or indirectly transmit the outputs of the plurality of motors to the driven unit.

7. The marine vessel according to claim 1, wherein the outputs of the plurality of motors are equal or substantially equal to each other.

8. The marine vessel according to claim 1, wherein the plurality of motors are disposed at equal or substantially equal intervals around a rotation center of the impeller.

9. The marine vessel according to claim 1, wherein all of the plurality of motors are disposed at locations higher than a rotation center of the impeller.

10. The marine vessel according to claim 1, further comprising:

a controller configured or programmed to control a rotational speed of each of the plurality of motors based on an indicated speed.

11. The marine vessel according to claim 1, further comprising:

a controller configured or programmed to selectively operate some, but not all, motors among the plurality of motors based on an indicated speed of the marine vessel.

12. A marine propulsion unit comprising:

a jet pump including an impeller;

a plurality of motors; and a transmission to transmit outputs of the plurality of motors to the impeller of the jet pump.

13. The marine propulsion unit according to claim 12, wherein the transmission includes:

a plurality of driven units corresponding to the plurality of motors, respectively, disposed at different locations in an axial direction of a rotating shaft of the impeller; and a plurality of drive units corresponding to the plurality of motors, respectively, to transmit the outputs of the plurality of motors to the corresponding driven units.

14. The marine propulsion unit according to claim 12, wherein the transmission includes:

a driven unit provided on a rotating shaft of the impeller; and a plurality of drive units corresponding to the plurality of motors, respectively, to transmit the outputs of the plurality of motors to the driven unit.

15. The marine propulsion unit according to claim 12, wherein the transmission includes:

a rim including a driven unit on an outer circumference of the rim, to hold the impeller on an inner circumference of the rim, and rotate integrally with the impeller; and a plurality of drive units fixed to output shafts of the plurality of motors, respectively, to directly or indirectly transmit the outputs of the plurality of motors to the driven unit.

16. The marine propulsion unit according to claim 12, wherein the outputs of the plurality of motors are equal or substantially equal to each other.

17. The marine propulsion unit according to claim 12, wherein the plurality of motors are disposed at equal or substantially equal intervals around a rotation center of the impeller.

* * * * *